US009354024B1

(12) United States Patent
Perry

(10) Patent No.: US 9,354,024 B1
(45) Date of Patent: May 31, 2016

(54) HAIR AND CLOTHING ITEM ATTACHABLE SELF-DEFENSE SPRAYER

(71) Applicant: Joe Perry, Oakland, CA (US)

(72) Inventor: Joe Perry, Oakland, CA (US)

( * ) Notice: Subject to any disclaimer, the term of this patent is extended or adjusted under 35 U.S.C. 154(b) by 0 days.

(21) Appl. No.: 14/681,347

(22) Filed: Apr. 8, 2015

(51) Int. Cl.
*F41H 9/10* (2006.01)
*B05B 11/06* (2006.01)

(52) U.S. Cl.
CPC . *F41H 9/10* (2013.01); *B05B 11/06* (2013.01)

(58) Field of Classification Search
CPC ..... F41H 9/10; B05B 7/1459; B05B 7/24; B05B 7/2402; B05B 7/2405; B05B 7/2408; B05B 7/241; B05B 7/2413; B05B 11/06
USPC ..... 239/152, 154, 158, 411, 654
See application file for complete search history.

(56) References Cited

U.S. PATENT DOCUMENTS 2,880,543 A * 4/1959 Von Frantzius ..... F41H 9/10 42/1.08
4,061,249 A * 12/1977 Smith ..... A44C 9/0053 109/32
4,135,645 A * 1/1979 Kimmell ..... F41H 9/10 141/330
4,667,851 A * 5/1987 Wilkerson ..... F41H 9/10 222/175
5,332,119 A * 7/1994 Davis ..... F41H 9/10 222/175
5,358,144 A * 10/1994 Mock ..... F41H 9/10 222/175
5,374,919 A * 12/1994 Zelka ..... G08B 15/004 224/196
5,503,304 A * 4/1996 Keller ..... F41H 9/10 222/175
5,629,679 A * 5/1997 Cranford ..... F41H 9/10 200/519
5,644,297 A * 7/1997 Masi ..... G08B 15/004 222/613
5,673,819 A * 10/1997 Brunswig ..... F41H 9/10 222/113
5,842,602 A * 12/1998 Pierpoint ..... G08B 15/004 222/1
5,901,723 A * 5/1999 Ames ..... A45B 3/14 135/66
5,921,442 A * 7/1999 Keller ..... B05B 11/0018 222/153.13
5,924,601 A * 7/1999 Chen ..... F41H 9/10 222/175
5,949,338 A * 9/1999 Masi ..... F41H 9/10 116/2

(Continued)

FOREIGN PATENT DOCUMENTS

DE 4445987 C1 * 3/1996 ..... F41H 9/10
WO WO 2010036402 A1 * 4/2010 ..... F41H 5/08

*Primary Examiner* — Arthur O Hall
*Assistant Examiner* — Viet Le
(74) *Attorney, Agent, or Firm* — Crossley & Stevenson IP Law

(57) ABSTRACT

A hair and clothing item attachable self-defense sprayer structured to permit use as a brooch attachable to a clothing item or a hair clip accessory by providing a support body having a concave internal side thereof, a hollow neck on a bottom portion of the support body, a central projection on the internal side, and a chamber within the neck which houses a pressurized gas chamber. An electronic activation mechanism activates gas release from a pressurized gas chamber in the neck which, in turn, forces the release of pressurized repellent therefrom through a spray nozzle and outwardly from at least one discharge opening in the projection toward an assailant. A plurality of camouflage members, which can be petal-shaped, is attached to a base on the rear side of each camouflage member to disguise the support body and to disguise the projection from recognition as a repellent dispenser.

9 Claims, 3 Drawing Sheets

(56) References Cited

U.S. PATENT DOCUMENTS 5,961,003 A * 10/1999 Coryell ..... F41H 9/10 222/175
5,988,450 A * 11/1999 Cassarino ..... F41H 9/10 222/192
6,540,106 B2 * 4/2003 Gerstner ..... F41H 9/10 222/107
6,546,661 B1 * 4/2003 Staubs ..... F41H 9/10 102/367
6,564,969 B1 * 5/2003 Loy ..... A44C 15/002 222/175
6,957,750 B1 * 10/2005 Trudell ..... A45B 3/14 135/66
9,062,930 B1 * 6/2015 Burke ..... F41C 9/00
2002/0145006 A1 * 10/2002 Slewidge ..... A61B 5/1411 222/6
2003/0034404 A1 * 2/2003 Truelove ..... F41H 9/10 239/154
2004/0046669 A1 * 3/2004 Chiapperini ..... F41H 9/10 340/574
2004/0066299 A1 * 4/2004 Hanabusa ..... F41H 9/10 340/574
2004/0184260 A1 * 9/2004 Kukuk ..... F21V 33/0064 362/96
2005/0188886 A1 * 9/2005 Vasel ..... F41B 11/57 102/502
2006/0175347 A1 * 8/2006 McNulty ..... F41B 9/00 222/79
2006/0194634 A1 * 8/2006 Maor ..... F41B 15/02 463/47.2
2007/0194048 A1 * 8/2007 Teig ..... F21V 33/0076 222/113
2008/0087684 A1 * 4/2008 Koshimoto ..... B65D 83/20 222/192
2008/0153602 A1 * 6/2008 Doan ..... A45F 5/00 463/47.4
2009/0038664 A1 * 2/2009 Juslin ..... A45B 3/00 135/66
2009/0071459 A1 * 3/2009 Wenaas ..... F41B 11/62 124/71
2009/0084818 A1 * 4/2009 Chung ..... F41H 9/10 222/153.02
2009/0127283 A1 * 5/2009 Smith ..... F41H 9/10 222/25
2009/0201621 A1 * 8/2009 Abatemarco ..... A45B 3/04 361/232
2010/0090026 A1 * 4/2010 Pearson ..... F41H 9/10 239/304
2010/0237103 A1 * 9/2010 Habermann ..... F41H 9/10 222/183
2010/0269762 A1 * 10/2010 Johnson ..... F41H 9/10 119/712
2011/0056989 A1 * 3/2011 Ceja ..... F41H 9/10 222/175
2012/0036990 A1 * 2/2012 Braun ..... F41B 11/52 89/37.01
2013/0016449 A1 * 1/2013 Crandall ..... F41H 9/10 361/232
2013/0092763 A1 * 4/2013 Spearman, Sr. ..... F41H 9/10 239/653
2014/0048561 A1 * 2/2014 Mangold ..... F41C 27/00 222/153.11
2014/0252028 A1 * 9/2014 Lord ..... G08B 21/02 222/79
2014/0263445 A1 * 9/2014 Rowlett ..... F41H 9/10 222/113
2015/0312399 A1 * 10/2015 Teig ..... H04M 1/72541 455/404.2
2016/0033238 A1 * 2/2016 Cooper ..... F41H 9/10 239/375

* cited by examiner

HAIR AND CLOTHING ITEM ATTACHABLE SELF-DEFENSE SPRAYER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

To all Whom it May Concern

Be it known that I, Joe Perry, a citizen of the United States, have invented new and useful improvements in a hair and clothing item attachable self-defense sprayer as described in this specification.

BACKGROUND OF THE INVENTION

Various types of personal attack-repellent devices worn by a user are known in the prior art including a chemical spraying bracelet, a wristwatch and a ring associated with a reservoir or canister and an activation mechanism for releasing the chemical spray from the bracelet, wristwatch, or ring. However, what is needed is a hair and clothing item attachable self-defense sprayer structured for use as a brooch and alternately as a hair clip.

FIELD OF THE INVENTION

The present invention relates to personal attack-repellent devices, and more particularly, to a hair and clothing item attachable self-defense sprayer disguised in a structure which permits selected use as a clothing-item attachable brooch and a hair clip structure.

SUMMARY OF THE INVENTION

The general purpose of the present hair and clothing item attachable self-defense sprayer, described subsequently in greater detail, is to provide a hair and clothing item attachable self-defense sprayer which has many novel features that result in a hair and clothing item attachable self-defense sprayer which is not anticipated, rendered obvious, suggested, or even implied by prior art, either alone or in combination thereof.

To accomplish this, the present hair and clothing item attachable self-defense sprayer having a structure which allows a selected use as a brooch or a hair clip by providing a support body having a concave internal side thereof, a hollow neck disposed on a bottom portion of the support body, a projection centrally disposed within the internal side, and a chamber within the neck which houses a pressurized gas chamber. An electronic activation mechanism configured to activate the release of gas from a pressurized gas chamber forces the release of an amount of pressurized repellent from the pressurized gas chamber through a spray nozzle and outwardly through at least one discharge opening in the projection toward an assailant. A plurality of camouflage members is provided to disguise the support body as being a conventional hair accessory or brooch normally worn by an individual and to disguise the projection from being recognized as a repellent dispenser. The interior end of each camouflage member, which can be a petal-shaped member, is attached along on a front side of the camouflage to the neck. A forward side of a base is centrally disposed on the rear side of each camouflage member. At least one of a brooch clasp and a spring-loaded hair clip is disposed on a rearward side of the base to attach the device to a clothing item or to a wearer's hair, respectively. The electric cable extends from the base, down the back of the wearer's neck, and through a sleeve of a clothing item worn by the wearer so that the control button is readily accessible for activation by pressure from the wearer's hand in the event of an attack by a person or an animal. By spraying repellent in an attacker's face and thwarting an immediate attack, the present device provides a wearer time to safely flee from the scene of an attack. Thus has been broadly outlined the more important features of the present hair and clothing item attachable self-defense sprayer so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
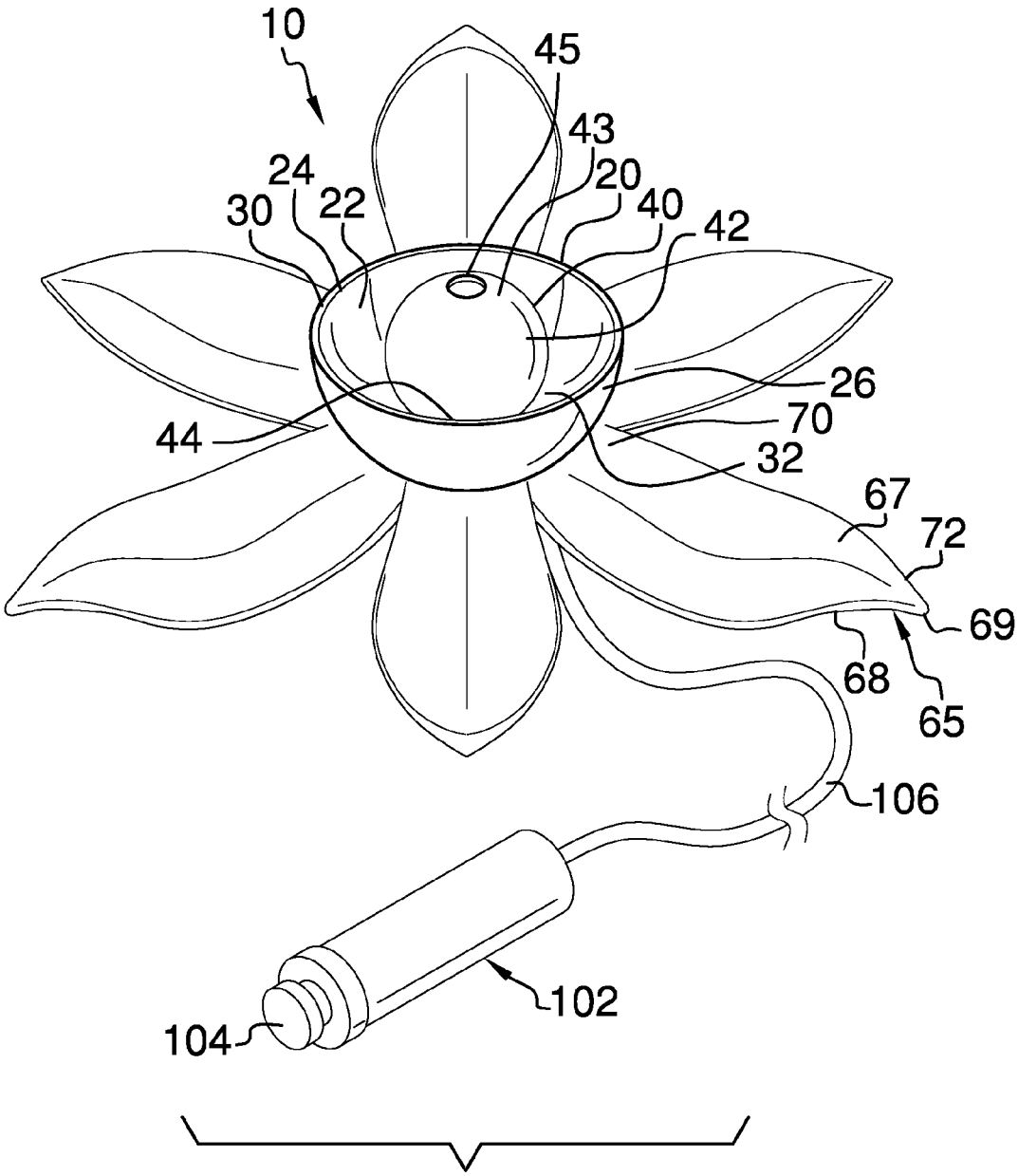
FIG. 1 is an isometric view.
Figure 2:
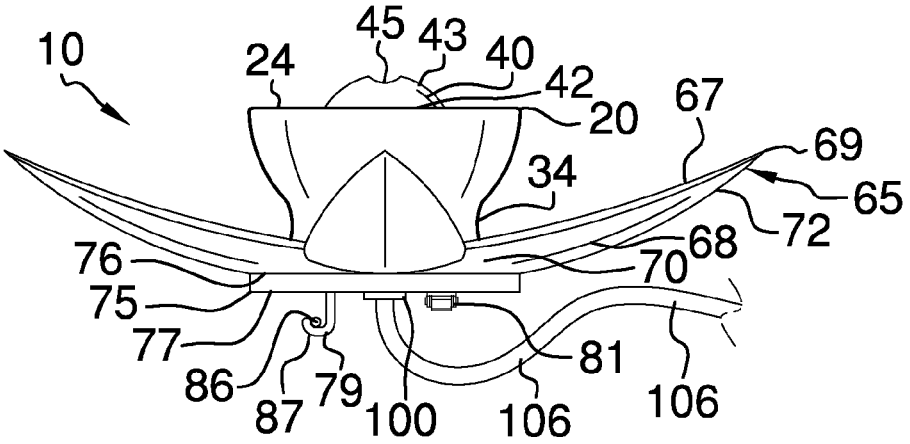
FIG. 2 is a side elevation view.
Figure 3:
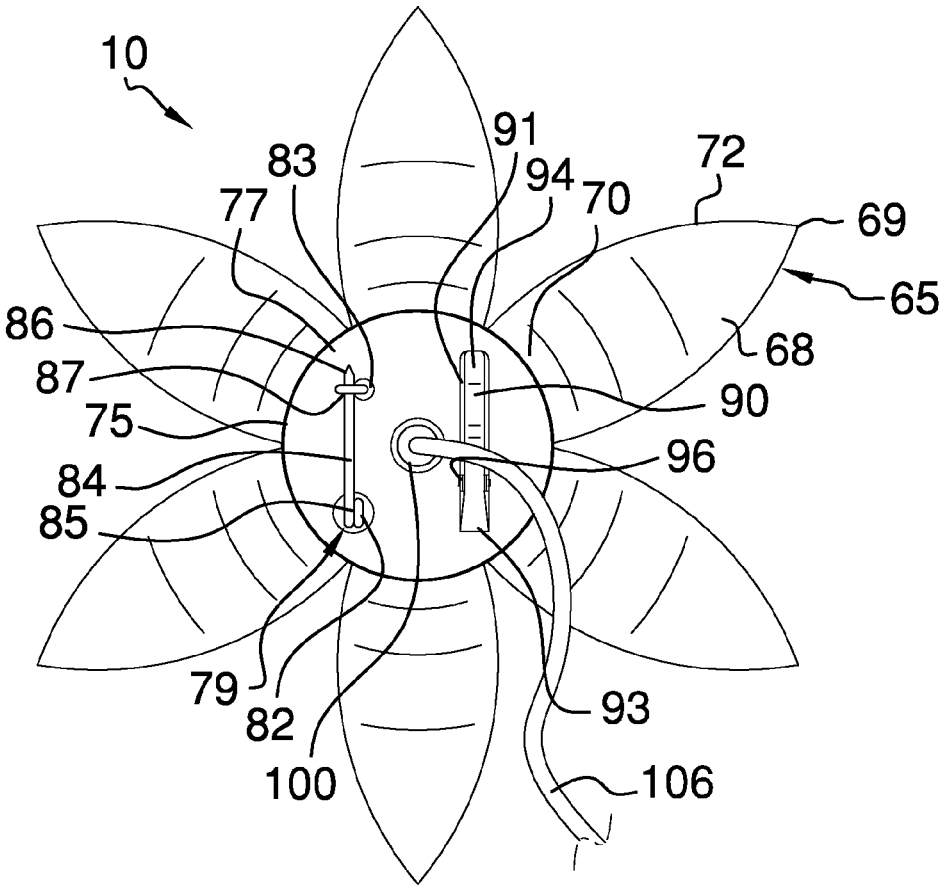
FIG. 3 is a rear elevation view.
Figure 4:
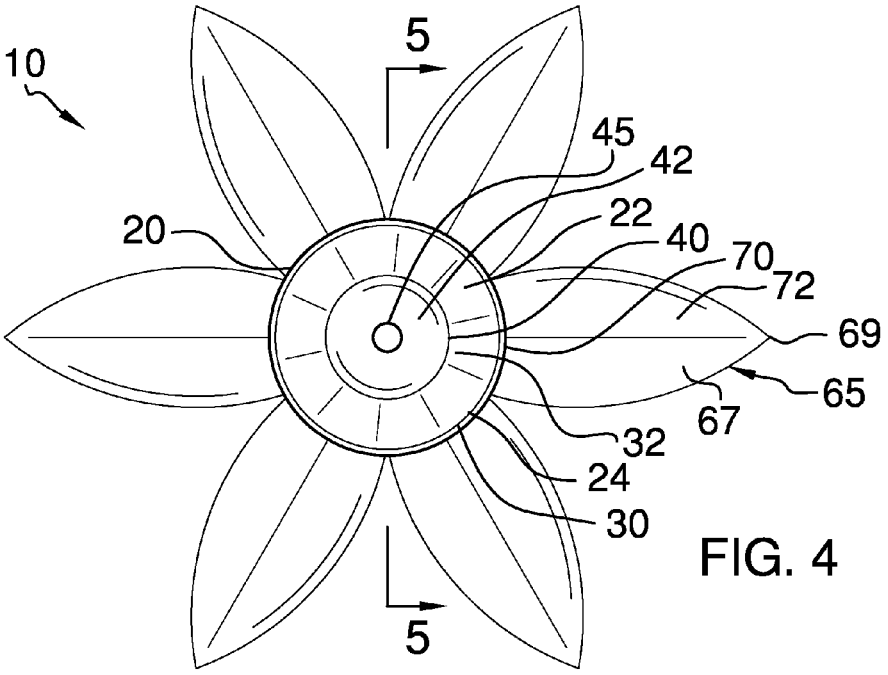
FIG. 4 is a front elevation view.
Figure 5:
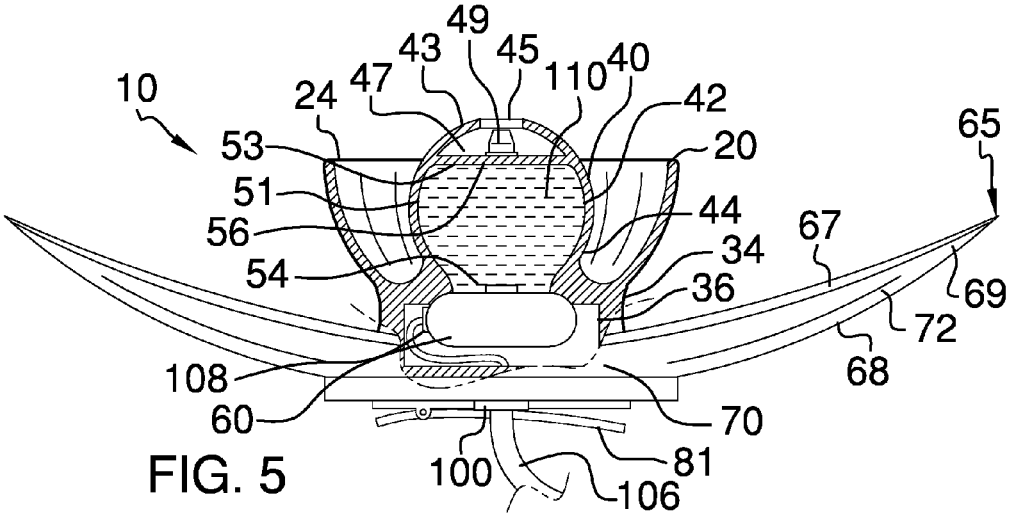
FIG. 5 is a cross-sectional view taken along line 5-5 of FIG. 4.

With reference now to the drawings, and in particular FIGS. 1 through 5 thereof, an example of the instant hair and clothing item attachable self-defense sprayer employing the principles and concepts of the present hair and clothing item attachable self-defense sprayer and generally designated by the reference number 10 will be described.

Referring to FIGS. 1 through 5 the present hair and clothing item attachable self-defense sprayer 10 is illustrated. The hair and clothing item attachable self-defense sprayer 10 includes a support body 20. The support body 20 has a concave internal side 22, an open forward side 24, an external side 26, a continuous outer periphery 30 between the internal side 22 and the external side 26, a bottom portion 32, and a hollow neck 34 disposed on the bottom portion 32. The support body 20 can be generally bowl-shaped as shown. A chamber 36 is disposed within the neck 34.

A generally spherical hollow projection 40 is centrally disposed on the internal side 22 of the support body 20 bottom portion 32 within the internal side. The projection 40 has an outer wall 42, a top side 43, and a bottom side 44. The top side 43 extends beyond the outer periphery 30. At least one discharge opening 45 is disposed through the outer wall 42 on the top side 43. An upper compartment 47 is disposed proximal the discharge opening 45 within the projection 40.

A spray nozzle 49 is disposed directly adjacent the at least one discharge opening 45. A reservoir 51 is disposed within the projection 40 directly adjacent the spray nozzle 49. The reservoir 51 has an upper side 53 and a lower side 54. The lower side 54 is disposed within the neck 34. A nozzle support 56 is disposed between the upper compartment 47 and the reservoir 51 upper side 53. The nozzle support 56 is configured to maintain the spray nozzle 49 in a position directed toward the discharge opening 45. A pressurized gas chamber 60, further described hereinbelow, is disposed within the chamber 36.

A plurality of camouflage members 65 is provided to disguise support body 20 as being a conventional hair accessory or brooch normally worn by an individual and to disguise the projection 40 as being a dispenser of a repellent. Each camouflage member 65 has front side 67, a rear side 68, an exterior end 69, and an interior end 70. The front side 67 of the interior end 70 is continuously disposed on the neck 34 between the chamber 36 and the external side 26 of the neck 36. The plurality of camouflage members 65 can be a plurality of petal-shaped members 72 as shown or can take another form consistent with the structure of the support body 20 that serves the functions of the present device 10.

A base 75 having a forward side 76 and a rearward side 77 is provided. The forward side 77 is centrally disposed on the rear side 68 of each of the camouflage members 65. At least one of a brooch clasp 79 and a spring-loaded hair clip 81 is disposed on the rearward side 77 of the base 75. The brooch clasp 79 can be a jewelry C-clasp as shown, which includes a first attachment base 82 attached to the rearward side 77 of the base 75. A second attachment base 83 is also attached to the rearward side 77 of the base 75 in a position spaced apart from the first attachment base 82. A pin 84, which is provided to attach the jewelry C-clasp 81 to a clothing item, has a first end 85 of the pin 84 is pivotably disposed on the first attachment base 82 and a second end 86. A C-shaped receptacle 87, which is disposed on the second attachment base 83, has a gap 88 perpendicular to the rearward side 77 of the base 75. The second end 86 of the pin 86 is configured to engage the C-shaped receptacle 87.

The spring-loaded hair clip 81 includes an elongated upper jaw member 90 and an elongated lower jaw member 91 parallel to the upper jaw member 90. Each of the upper and lower jaw members 90, 91 has a grip portion 93 and a tip 94 on an opposite end from the grip portion 93. A spring-loaded hinge 96 is disposed between the upper and lower jaw members 90, 91 proximal the grip portion 93. The upper jaw member 90 pivotally engages the lower jaw member 91 at the hinge 96. Placement of pressure on the grip portion 93 of each of the upper and lower jaw members 90, 91 separates the tip 94 of upper jaw member 90 away from the tip 94 of the lower jaw member 91. The spring-loaded hair clip 81 can be a spring-loaded duckbill square clip as shown or other spring-loaded hair clip 81 which is consistent with the structure and promotes the functionality of the present device 10.

An inlet port 100 is disposed through the forward and rearward sides 76, 77 of the base 75. An electronic activation mechanism 102 including a control button 104 and an electric cable 106 serves to activate a repellent-dispensing function of the device 10. An electrically actuated valve 108 is in operational communication with the pressurized gas chamber 60. The electric cable 106 is in operational communication with the control button 104 and the valve 108. The electronic activation mechanism 102 is configured to activate and alternately deactivate the valve 108 upon respective placement and alternate release of pressure upon the control button 104. Activation of the valve 108 releases gas from the pressurized gas chamber 60 into the reservoir 51. An amount of pressurized repellent 110 is disposed within the reservoir 51. Release of gas from the pressurized gas chamber 60 into the reservoir 51 forces the amount of pressurized repellent 110 through the spray nozzle 49 and from the spray nozzle 49 through the at least one discharge opening 45 in the top side 43 of the projection 40 in a direction away from the projection 40 and toward an assailant. The electric cable 106 has a length configured to extend from the base 75, down the back of the wearer's neck, and through a sleeve of a clothing item worn by the wearer so that the control button 104 is readily accessible for activation by pressure from the wearer's hand.

What is claimed is:

1. A hair and clothing item attachable self-defense sprayer comprising:

a support body having a concave internal side, an open forward side, an external side, a continuous outer periphery between the internal side and the external side, a bottom portion, and a hollow neck disposed on the bottom portion;

a chamber disposed within the neck;

a hollow projection centrally disposed on the internal side of the support body bottom portion within the internal side, the projection having an outer wall, a top side, and a bottom side, wherein the top side extends beyond the outer periphery;

at least one discharge opening disposed through the outer wall on the top side;

an upper compartment disposed proximal the discharge opening within the projection;

a spray nozzle disposed directly adjacent the at least one discharge opening;

a reservoir disposed within the projection directly adjacent the spray nozzle, the reservoir having an upper side and a lower side, the lower side disposed within the neck;

a nozzle support disposed between the upper compartment and the reservoir upper side, wherein the nozzle support is configured to maintain the spray nozzle in a position directed toward the opening;

a pressurized gas chamber disposed within the chamber;

a plurality of camouflage members having front side, a rear side, an exterior end, and an interior end, the front side of the interior end being continuously disposed on the neck between the chamber and the external side of the neck;

a base having a forward side and a rearward side, the forward side being centrally disposed on the rear side of each of the camouflage members;

at least one of a brooch clasp and a spring-loaded hair clip disposed on the rearward side of the base;

an inlet port disposed through the forward and rearward sides of the base;

an electrically actuated valve in operational communication with the pressurized gas chamber;

an electronic activation mechanism in operational communication with the valve, wherein the electronic activation mechanism is configured to activate and alternately deactivate the valve upon respective placement and alternate release of pressure upon the control button;

wherein activation of the valve releases gas from the pressurized gas chamber into the reservoir;

an amount of pressurized repellent disposed within the reservoir, wherein release of gas from the pressurized gas chamber into the reservoir forces the amount of pressurized repellent through the spray nozzle and from the spray nozzle through the at least one discharge opening in the top side of the projection and away from the projection.

2. The hair and clothing item attachable self-defense sprayer of claim 1 wherein the brooch clasp is a jewelry C-clasp comprising:

a first attachment base attached to the rearward side of the base;

a second attachment base attached to the rearward side of the base, the second attachment base spaced apart from the first attachment base;

a pin having a first end pivotably disposed on the first attachment base and a second end; and a C-shaped receptacle disposed on the second attachment base, the C-shaped receptacle having a gap perpendicular to the rearward side of the base;

wherein the second end of the pin is configured to engage the C-shaped receptacle; and wherein the spring-loaded hair clip comprises:

an elongated upper jaw member;

an elongated lower jaw member parallel to the upper jaw member, each of the upper and lower jaw members having a grip portion and a tip on an opposite end from the grip portion; and a spring-loaded hinge disposed between the upper and lower jaw members proximal the grip portion, wherein the upper jaw member pivotally engages the lower jaw member at the hinge;

wherein placement of pressure on the grip portion of each of the upper and lower jaw members separates the tip of upper law member away from the tip of the lower jaw member.

3. The hair and clothing item attachable self-defense sprayer of claim 1 wherein the plurality of camouflage members comprises a plurality of petal-shaped members.

4. The hair and clothing item attachable self-defense sprayer of claim 2 wherein the spring-loaded hair clip is a spring-loaded duckbill square clip.

5. The hair and clothing item attachable self-defense sprayer of claim 2 wherein the plurality of camouflage members comprises a plurality of petal-shaped members.

6. A hair and clothing item attachable self-defense sprayer comprising:

a generally bowl-shaped support body, the support body having a concave internal side, an open forward side, an external side, a continuous outer periphery between the internal side and the external side, a bottom portion, and a hollow neck disposed on the bottom portion;

a chamber disposed within the neck;

a generally spherical hollow projection centrally disposed on the internal side of the support body bottom portion within the internal side, the projection having an outer wall, a top side, and a bottom side, wherein the top side extends beyond the outer periphery;

at least one discharge opening disposed through the outer wall on the top side;

an upper compartment disposed proximal the discharge opening within the projection;

a spray nozzle disposed directly adjacent the at least one discharge opening;

a reservoir disposed within the projection directly adjacent the spray nozzle, the reservoir having an upper side and a lower side, the lower side disposed within the neck;

a nozzle support disposed between the upper compartment and the reservoir upper side, wherein the nozzle support is configured to maintain the spray nozzle in a position directed toward the opening;

a pressurized gas chamber disposed within the chamber within the neck;

a plurality of camouflage members having front side, a rear side, an exterior end, and an interior end, the front side of the interior end being continuously disposed on the neck between the chamber and the external side of the neck;

a base having a forward side and a rearward side, the forward side being centrally disposed on the rear side of each of the camouflage members;

at least one of a brooch clasp and a spring-loaded hair clip disposed on the rearward side of the base, wherein the brooch clasp is a jewelry C-clasp comprising:

a first attachment base attached to the rearward side of the base;

a second attachment base attached to the rearward side of the base, the second attachment base spaced apart from the first attachment base;

a pin having a first end pivotably disposed on the first attachment base and a second end; and a C-shaped receptacle disposed on the second attachment base, the C-shaped receptacle having a gap perpendicular to the rearward side of the base;

wherein the second end of the pin is configured to engage the C-shaped receptacle; and wherein the spring-loaded hair clip comprises:

an elongated upper jaw member;

an elongated lower jaw member parallel to the upper jaw member, each of the upper and lower jaw members having a grip portion and a tip on an opposite end from the grip portion; and a spring-loaded hinge disposed between the upper and lower jaw members proximal the grip portion, wherein the upper jaw member pivotally engages the lower jaw member at the hinge;

wherein placement of pressure on the grip portion of each of the upper and lower jaw members separates the tip of upper law member away from the tip of the lower jaw member;

an inlet port disposed through the forward and rearward sides of the base;

an electronic activation mechanism including a control button and an electric cable;

an electrically actuated valve in operational communication with the pressurized gas chamber, wherein the electric cable is in operational communication with the control button and the valve, further wherein the electronic activation mechanism is configured to activate and alternately deactivate the valve upon respective placement and alternate release of pressure upon the control button;

wherein activation of the valve releases gas from the pressurized gas chamber into the reservoir; and an amount of pressurized repellent disposed within the reservoir, wherein release of gas from the pressurized gas chamber into the reservoir forces the amount of pressurized repellent through the spray nozzle and from the spray nozzle through the at least one discharge opening in the top side of the projection and away from the projection.

7. The hair and clothing item attachable self-defense sprayer of claim 6 wherein the plurality of camouflage members comprises a plurality of petal-shaped members.

8. The hair and clothing item attachable self-defense sprayer of claim 6 wherein the spring-loaded hair clip is a spring-loaded duckbill square clip.

9. The hair and clothing item attachable self-defense sprayer of claim 7 wherein the spring-loaded hair clip is a spring-loaded duckbill square clip.

* * * * *